United States Patent [19]

Dorsey

[11] Patent Number: 4,700,158

[45] Date of Patent: Oct. 13, 1987

[54] HELICAL RESONATOR

[75] Inventor: Denis P. Dorsey, Levittown, Pa.

[73] Assignee: RCA Corporation, Princeton, N.J.

[21] Appl. No.: 913,324

[22] Filed: Sep. 30, 1986

[51] Int. Cl.[4] ..... H01P 7/00; H01P 1/20

[52] U.S. Cl. ..... 333/202; 333/219; 333/222; 333/245

[58] Field of Search ..... 333/202, 204, 205, 219, 333/234, 238, 185, 206–208, 245, 246, 222–231, 235; 336/196–200, 205–208, 84 C

[56] References Cited

U.S. PATENT DOCUMENTS

| | | | |
|---|---|---|---|
| 2,583,854 | 1/1952 | Kehbel | 333/234 |
| 4,494,100 | 1/1985 | Stengel et al. | 336/200 |
| 4,531,109 | 7/1985 | Olsen | 336/87 |

FOREIGN PATENT DOCUMENTS

| | | | |
|---|---|---|---|
| 0140901 | 7/1985 | Japan | 333/202 |
| 632834 | 5/1950 | United Kingdom | 333/238 |
| 639145 | 6/1950 | United Kingdom | 333/234 |

OTHER PUBLICATIONS

"Low-Loss Ceramics for Radio-Frequency Use", by G. P. Britton, Electronic Engineering, Jul. 1941, pp. 301–303 and 318.

*Primary Examiner*—Marvin L. Nussbaum

*Attorney, Agent, or Firm*—Paul J. Rasmussen; Peter M. Emanuel; Thomas F. Lenihan

[57] ABSTRACT

A helical resonator comprises an insulating body portion having therein a cavity. In one embodiment, a helical conductor is formed on the inside wall of the cavity and another conductor is formed on the outside of the insulating body. In another embodiment, the helical conductor is formed on the outside of the insulating body and the other conductor is formed on the outside wall of the cavity. In a preferred embodiment, the disclosed helical resonator is formed as an integral part of the body of a signal coupler for coupling an antenna to a tuner and electrically forms a series tuned trap connected between conductors of the signal coupler.

8 Claims, 7 Drawing Figures

HELICAL RESONATOR

FIELD OF THE INVENTION

The present invention relates to the field of helical resonators, such as may be used, for example, in a television (TV) radio frequency (RF) filter such as that described in U.S. patent application Ser. No. 869,176, filed May 30, 1986 in the name of Denis Peter Dorsey and assigned to RCA Corporation.

BACKGROUND OF THE INVENTION

The TV RF signals derived from, for example, a TV antenna, a video cassette recorder, or a cable distribution system are generally coupled to a TV receiver by way of a transmission line. Typically, a twin lead transmission line is employed, its wire ends being fitted with spade lugs, for example, made to fit the clamping screw RF input terminals generally provided on the back panel of the receiver. Normally, the tuner portion of the receiver is enclosed within a shielded unit located in the receiver cabinet at a short distance from the back panel and the RF input signal is coupled from the receiver input terminals to the tuner unit by a pair of conductors.

With this arrangement, an interfering signal that may be present at the receiver input terminals together with a desired signal will be coupled to the tuner unit along with the desired signal. Interfering signals which occur outside the normal tuning frequency range of the receiver may be sufficiently strong to cause undesirable interference with desired signals within the tuning range. For example, interfering signals from non-television sources commonly occur at frequencies above the ultra high frequency (UHF) television broadcast band and such signals are known to interfere with UHF TV signals. In order to attenuate such interfering signals, the tuner unit may incorporate one or more wave-traps, which are used despite the added cost they entail. Such a wave-trap may typically comprise a series resonant circuit tuned to the frequency of an expected interfering signal, so as to shunt it to ground through a low impedance. However, when such a wave-trap is incorporated within the tuner unit, circulating currents at the interfering signal frequency will flow inside the tuner unit and these currents will tend to get into the signal path, thus reducing the effectiveness of the wave-trap. It is recognized that it is preferrable to place the wave-trap outside the tuner unit, i.e. between the input terminals and the tuner unit, so as to keep circulating currents at interfering frequencies outside the tuner unit. However, it has been common practice to incorporate wave-trap components within the tuner unit in order to avoid the added expense of separately housing and mounting such components externally to the tuner unit.

In inplementing a series resonant circuit for a wave-trap, it is desirable to avoid utilizing a wire-wound inductor which is relatively costly and which may require adjustments in production. An inductor having an inductance value suitable for a UHF wave-trap can be implemented on a printed cirucit board by using a conductive spiral path. Such an inductor is known from U.S. Pat. No. 4,494,100 (Stengel et al.) issued 15 January 1985. However, spiral form inductors on printed circuit boards tend to be very lossy and to exhibit a low Q (quality factor). Accordingly, such inductors tend to degrade the performance of a resonant circuit.

Plating the inside and outside surfaces of a cylindrical form closed at one end to produce a high voltage capacitor is known from "Low-Loss Ceramics for Radio-Frequency Use", by G. P. Britton, "Electronic Engineering", July 1941, pp. 301–303 and 318. This article also teaches that a helical conductor may be plated on the outside of a solid coil form to produce a stable inductor. The Britton article however is no directed to the fabrication of helical resonators.

SUMMARY OF THE INVENTION

In accordance with a first aspect of the invention, a helical resonator comprises an insulating body portion having therein a cavity. A helical conductor is formed on either an inside wall of the cavity or the outside surface of the insulating body, and a further conductor is formed on the other of the inside wall or outside surface.

In accordance with a second aspect of the invention, the inductor inside wall is substantially cylindrical.

In accordance with a third aspect of the invention, an internal helical thread portion is formed on the inside wall and the helical conductor is formed on the helical thread portion.

In accordance with a fourth aspect of the invention the helical conductor is formed by plating.

In accordance with a fifth aspect of the invention, an input signal coupler has an insulating body portion, first and second input connection points, and first and second output connection points. First and second plated conductors are formed on the insulating body portion, the first plated conductor being coupled between the first input and output connection points, and the second plated conductor being coupled between the second input and output connection points. A substantially cylindrical cavity portion is formed in the insulating body portion. The signal coupler includes a filter comprising a helical thread portion formed in the cylindrical cavity and a plated helical conductor formed on the helical thread portion. One end of the plated helical conductor is coupled to the first conductor. A further plated conductor formed on the insulating portion outside the cylindrical cavity is coupled to the second conductor.

BRIEF DESCRIPTION OF THE DRAWING

FIG. 5*b* shows the equivalent circuit of the embodiment of FIG. 5a.

DETAILED DESCRIPTION OF THE DRAWING

Figure 1:
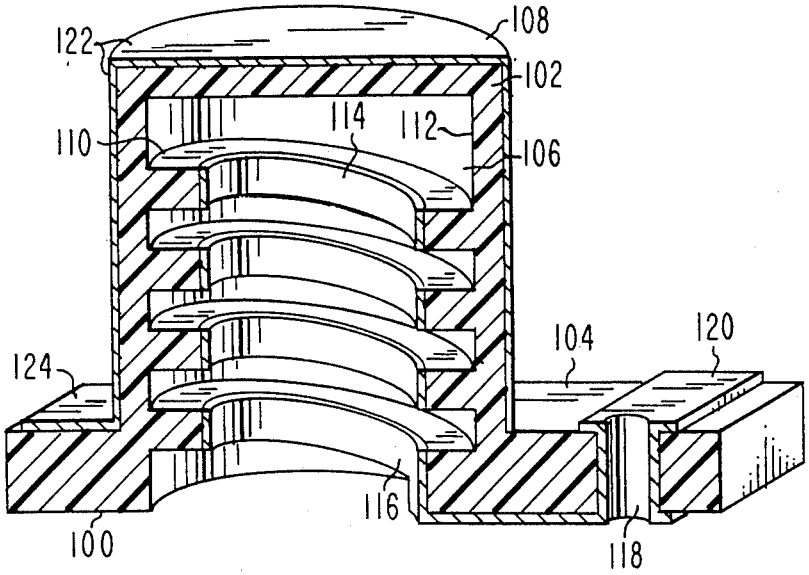
FIG. 1 is a cross-section view of the helical resonator of the invention showing the internal detail thereof.

In the helical resonator of FIG. 1, 100 is an insulating body portion having a generally cylindrical part 102 having a central axis of symmetry approximately at a right angle to a generally flat base portion 104. Insulating body portion 100 is made of an insulating material, preferably molded plastic. Body portion 100 includes a generally cylindrical cavity 106, enclosed at one end by a substantially flat top portion 108. The other end of cavity 106 is open. A helical screw thread 110 having a rectangular cross-sectional profile is formed on the inside wall 112 of cavity 106. Helical thread 110, being formed of the same material as body 100. If a helical conductor is to be plated on the inside wall of cavity 106, a plating mask having the helical pattern desired must be inserted temporarily in the unit and then removed for use in the next unit. Repeated insertion and removal of the plating mask may tend to deform it, causing the conductor spacing to vary from unit to unit. Helical thread 110 solves the problem by allowing the plating mask to be screwed into cavity 106, thus ensuring that the plated coil spacing remains essentially constant from unit to unit. The plating process is described below.

The thread surface closest to the central axis of helical thread 110 is plated with conductive metal, so as to form a helical conductor 114. A typical additive conductor plating process may take the following form. After molding, the unit to be plated is submitted to an adhesion promotion process where the unit is wet chemically etched and becomes porous. The board is then sensitized allowing the sensitizing agent to leach into the pores. The unit is now ready for photoprinting. For the photoprinting step, a mask or light shield is made to conform with the non-conductive surface. The mask can be computer generated or developed from the photo artwork. The mask is then placed in intimate contact with the unit and the unit exposed to ultraviolet light (UV) over all surfaces. After the UV exposure process, a thin copper pattern will appear as a result of the UV action on the exposed sensitizing agent. The unit can now be fixed and developed in preparation for an initial flash plating. The plating bath, which is a batch process, adds a thin layer of copper to the conductor paths. Flash plating requires about one hour to add approximately 0.20 mils of copper to the surface. At this stage of processing, the units can be stripped of the copper flashing and be returned to photoprinting for any corrections or engineering changes if necessary. When finalized, the units are ready for the restoring and additive plating procedure where the either 1.0 oz. or 2.0 oz. copper can be deposited on the copper flash. Plating of this type is available from, for example, CIRCUIT-WISE Inc. of North Haven, Conn., and PCK Inc. of Melville, N.Y. The upper and lower exposed surfaces of helical thread 110 are left unplated, i.e. in a non-conductive state. The metal plating extends from the lowest end portion 116 of helical thread 110 to form a conductor formed on the under surface of base portion 104 which is connected through a plated-through hole 118 to a further conductor 120 on the upper surface of base portion 104.

Metal plating 122 is also formed on the outside surfaces of cylindrical part 102 and top portion 108 and is connected to a conductor 124 formed on the upper surface of base portion 104, approximately on the diametrically opposite side of cylindrical part 102 relative to conductor 120.

Helical conductor 114 is in the form of a solenoidal inductance coil having one end connected to conductor 120. Each part of helical conductor 114 exhibits capacitance to metal plating 122. The distributed capacitance may be lumped together in a single equivalent capacitor so that a series inductance-capacitance resonant circuit is coupled between conductors 120 and 124. The solenoidal form of inductance coil provided by helical conductor 114 exhibits a high Q and forms a series resonant circuit which functions efficiently as a wavetrap.

Figure 6:
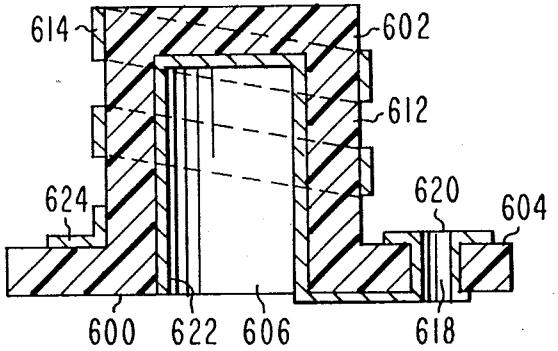
FIG. 6 shows a cross-section view of another alternate embodiment of the invention.

FIG. 6 shows an alternate embodiment of the helical resonator of the invention. The elements identified by the reference numerals of FIG. 6 correspond to the elements of FIG. 1 using similar reference numerals. A helical resonator 600 comprises an insulating cylindrical body 602 having a cavity 606 therein, and a generally flat portion 604 at essentially a right angle to the cylindrical portion. A helical conductor 614 is plated on the outside of the cylindrical portion. The spaces 612 between the turns of helical conductor 614 are substantially non-conductive. A further conductor 622 is plated onto the inside wall of cavity 606 and is connected to terminal 620 via a plated-through hole 618. Helical conductor 614 is connected to terminal 624 at its lower end, the upper end of helical conductor 614 being unconnected to any other circuit. The helical resonator of FIG. 1 advantageously encloses the helical conductor within the body of the device thus protecting the plated helical conductor from accidental damage during manufacture caused by mishandling.

Figure 2:
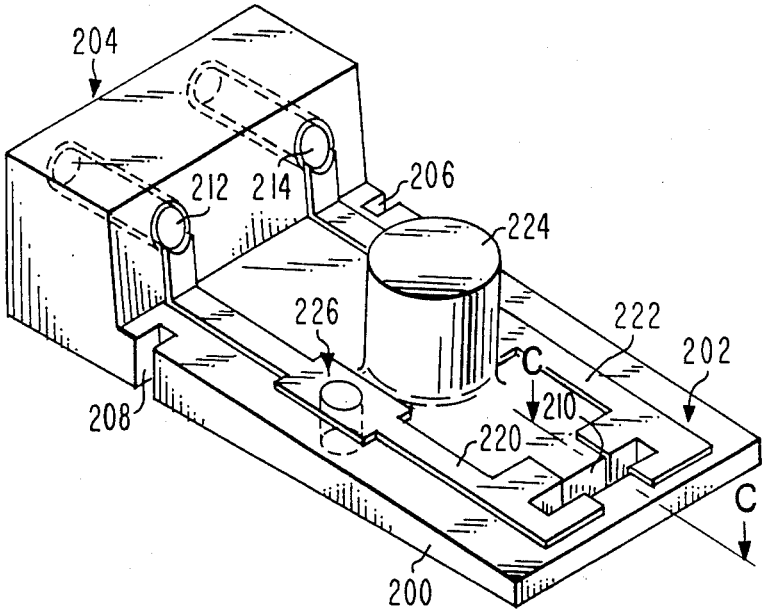
FIG. 2 shows a perspective view of the helical resonator of FIG. 1 mounted on a signal coupler.

In the signal coupler of FIG. 2, 200 is an insulating body having a generally rectangular flat portion 202 and an end portion 204 extending approximately at a right angle from the surface of portion 202. Mounting slots, 206 and 208, are provided on each side of portion 202 and a connection slot 210 is provided adjacent to the end of portion 202 which is remote from end portion 204. Two terminal holes, 212 and 214 are provided through end portion 204. The inside surfaces of holes 212 and 214 are metal-plated so as to be electrically conductive. A first conductor 220, formed by plating on body portion 202, is joined to the plating inside hole 212 and its other end extends into slot 210. A second conductor 222, running approximately parallel to conductor 220, is also formed by plating on body portion 202. One end of conductor 222 is joined to the plating inside hole 214 and its other end extends into slot 210.

Figure 3:
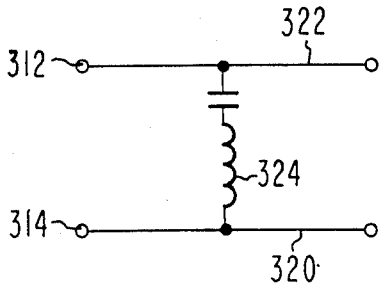
FIG. 3 shows in schematic form an equivalent circuit for the signal coupler of FIG. 2.

A helical resonator 224 of the type shown in FIG. 1 and described above is formed on an insulating body 200, preferably integrally molded with it. The base portion for helical resonator 224, (corresponding to base portion 104 for the helical resonator shown in FIG. 1) is an integral part of the body 202. The end of a helical conductor in helical resonator 224 is connected by a conductor plated on the under surface of body 200, through a plated-through hole 226, to conductor 220. The conductive metal plating on the outside surface of helical resonator 224 is connected to conductor 222 by way of a conductor plated on the upper surface of body 200. The series resonant circuit formed by conductor 224 and its capacitance is thereby coupled between conductors 220 and 222. The helical resonator shown in FIG. 6 may be used in place of helical resonator 224. An equivalent circuit is shown in FIG. 3. Corresponding parts in FIGS. 2 and 3 are designated by reference numerals having the same last two digits.

Signal coupler 200 may, for example, be mounted on a tuner unit (not shown in FIG. 2) in a television receiver by means of fasteners (not shown) passing through slots 206 and 208. Tuner input leads can be soldered to the ends of conductors 220 and 222 in slot 210. Holes 212 and 214 are arranged to be accessible through an opening in the receiver back panel. Signal leads are then clamped by, e.g., self-tapping terminal screws driven into holes 212 and 214.

In operation, conductors 220 and 222 couple signals from the input at plated terminal holes 212 and 214 to connections made in slot 210 to the tuner. The series resonant circuit coupled between conductors 220 and 222 exhibits a low impedance at resonance and a relative high impedance off resonance. A rejection filter is thus formed with the series resonant circuit being the shunt element and the impedance of the signal source being the series element. The resonant frequency of the the resonant circuit is selected to coincide with the frequency of an interfering signal, which is thereby attenuated without significantly affecting signals of other frequencies.

In this manner, interfering signals are attenuated before they reach e.g. the tuner in a TV receiver, thus avoiding the possibility of circulating currents within the tuner from reentering the signal path. All of the conductors shown in FIGS. 1 and 2 are plated onto the body portions at the same time. Accordingly, the resonant circuit is formed at practically no additional cost over that of providing conductors 220 and 222 and plated holes 2I2 and 214.

Figure 4:
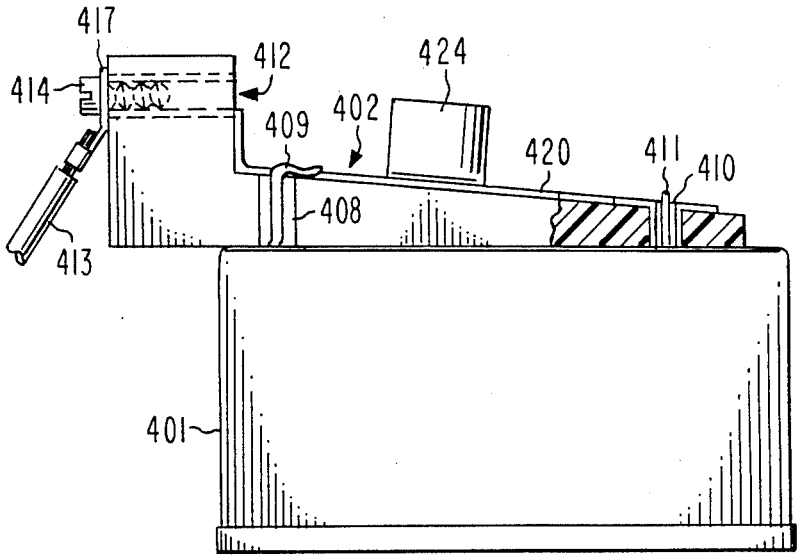
FIG. 4 shows a side view of the signal coupler of FIG. 2 mounted on a tuner unit including a partial section view along section line C—C of FIG. 2.

FIG. 4 shows the signal coupler of FIG. 2 mounted on a tuner unit 401. The tuner unit 401 has a protruding tab 409 which passes through slot 408 and is shaped to maintain pressure against surface 402 so as to hold the signal coupler in place on tuner 401. Input terminal pins for the tuner extend from tuner unit 401 into slot 410 and are soldered to conductors 420 and 422 respectively, as illustrated by pin 411 in FIG. 4. A signal lead 413 comprises a signal conductor terminated in a spade lug 417 which is clamped against conductor 417 by a terminal screw 414 driven into terminal hole 412.

Figure 5B:
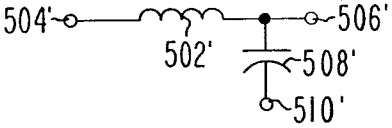
Figure 5A:
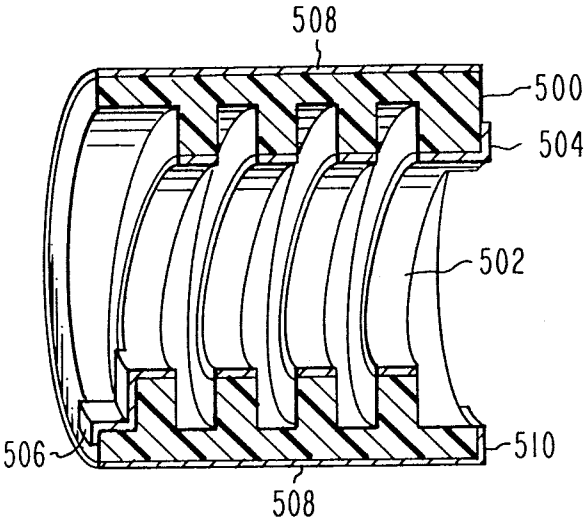
FIG. 5*a* shows a cross-section view of an alternate embodiment of the invention.

While in the illustrated embodiments of FIGS. 1 and 6, the helical conductor portion has a terminal at one end only, an alternate embodiment as shown in FIG. 5*a* has two terminals 504 and 506 at respective ends of helical conductor 502 to allow the unit to be used in series with a signal path rather than in shunt with a signal path as disclosed above. In the alternate arrangement, conductive terminals 504 and 506 at respective ends of the helical conductor 502 are isolated from the conductive outer surface 508 of the cylindrical body 500. Conductive outer surface 508 is connected to a terminal 510 to facilitate electrical connection to other circuitry. Terminal 510 may be connected, for example, to ground or other source of reference potential. FIG. 5*b* shows the equivalent circuit of the embodiment of FIG. 5*a*. The reference numerals of FIG. 5*b* correspond to those of FIG. 5*a*

Clearly, the implementation of the invention as described is illustrative. Modifications for implementing the invention in accordance with the foregoing description will suggest themselves to one skilled in the art. For example, the cross-sectional profile of the helical thread need not be rectangular. Furthermore, the thread need not be in a cylindrical helix. For example, the helix could be tapered or conical.

These and other modifications are contemplated to be within the scope of the present invention which is defined by the claims following.

What is claimed is:

1. In an input signal coupler having an insulating body portion, first and second input connection points, first and second output connection points, first and second plated conductor means formed on said insulating body portion, said first plated conductor means being coupled between said first input and output connection points, and said second plated conductor means being coupled between said second input and output connection points, and a substantially cylindrical cavity portion formed in said insulating body portion, filter means comprising:

a helical thread portion formed in said cylindrical cavity;

plated helical conductor means formed on said helical thread portion, said plated helical conductor means having one end threeof coupled to said first conductor means; and further plated conductor means formed on said insulating portion outside said cylindrical cavity, said further plated conductor means being coupled to said second conductor means.

2. A filter as recited in claim 1 wherein cylindrical cavity is enclosed by a cylindrical wall portion of said insulating body portion, said wall portion having a thickness small in comparison with the diameter of said cylindrical cavity.

3. A filter as recited in claim 2 wherein a portion of said further plated conductor means is formed on said cylindrical wall portion of said insulating body portion.

4. A filter as recited in claim 3, wherein said cylincrical cavity is further enclosed by a substantially flat end portion and a further portion of said further plated conductor is formed on said substantially flat portion, outside said cavity.

5. A filter as recited in claim 1 wherein said helical thread portion is of substantially rectangular cross-section such that said plated helical conductor is of substantially flat cross-section.

6. A filter as recited in claim 4 wherein said plated helical conductor forms a series resonant circuit with the capacitance between said further plated conductor and said plated helical conductor, said series resonant circuit being coupled between said first and second conductors.

7. A helical resonator comprising:

an insulating cylindrical body, having therein a cylindrical cavity;

helical thread formed on the inside wall of said cavity;

said helical thread having a cross-sectional profile exhibiting an inner portion closest to the central axis of said cylindrical cavity, and an outer portion farthest from said central axis;

a plated conductor plated on said inner portion of said thread closest to said central axis of said cylindrical cavity so as to form a helix therewith, said plated conductors being formed on said inner portion of said cross-sectional profile of said thread such that a non-conducting gap remains between adjacent turns of said helix formed by said plated conductor throughout said helix; and a further conductor formed on the outside surface of said body, said plated conductor and said further conductor forming a series resonant circuit.

8. A filter, comprising:

an insulating cylindrical body having an aperture therethrough;

an internal helical thread portion being formed on the inside surface of said cylindrical body;

said helical thread having a cross-sectional profile exhibiting an inner portion closest to the central axis of said aperture, and an outer portion fartheset from said central axis;

a helical conductor plated on the said inner portion of said helical thread closest to the central axis of said cylindrical body;

first and second terminals connected to the respective ends of said helical conductor, said first and second terminals being located at the respective ends of said aperture; and a further conductor formed on the outside surface of said cylinder.

* * * * *